United States Patent [19]

Weinstein

[11] 4,097,934

[45] Jul. 4, 1978

[54] UNIFORM CAP

[76] Inventor: Bernard Weinstein, 1040 E. 3rd St., Hialeah, Fla. 33010

[21] Appl. No.: 665,247

[22] Filed: Mar. 9, 1976

[51] Int. Cl.[2] ..... A42B 1/02

[52] U.S. Cl. ..... 2/195; 2/179

[58] Field of Search ..... 2/195, 171, 171.1, 180, 2/179, 175; 24/208 R

[56] References Cited

U.S. PATENT DOCUMENTS

| | | | |
|---|---|---|---|
| 1,789,604 | 1/1931 | Slutzker | 2/195 |
| 2,043,330 | 6/1936 | Nelkin | 2/179 |
| 2,389,689 | 11/1945 | Scheppler | 2/195 |
| 2,393,270 | 1/1946 | Schlesinger | 2/195 |
| 2,616,092 | 11/1952 | Berg | 2/195 |
| 2,648,110 | 8/1953 | Baskind | 24/208 R |
| 2,814,047 | 11/1957 | Lev | 2/195 |
| 3,473,168 | 10/1969 | Gallin | 2/195 |

FOREIGN PATENT DOCUMENTS

| | | | |
|---|---|---|---|
| 528,971 | 8/1956 | Canada | 2/195 |

*Primary Examiner*—Peter Nerbun

*Attorney, Agent, or Firm*—Wolf, Greenfield & Sacks

[57] ABSTRACT

An improvement is provided in a uniform cap having a frame sized to fit the head of a user, a flexible replaceable cover, releasable means for aligning and fastening said cover to said frame, an adjustable stretching band to stretch said cover into its deployed condition and a braid band. The adjustable stretching band has a fanged loop means attached to one end thereof and through which the other end threads. A slidable releasing means brings said fangs into engagement with said other end to secure said stretching band at one side. Said cover has a lower portion formed of elastic material so that said cover may be used with frames of different sizes. Said frame has a male snap, facing outwardly, located front and center to engage a male-female snap in said cover. When the male-female snap is so engaged its male portion is aligned front and center of the cap. The braid band has an inwardly facing female snap at its front center so that when it is engaged with said male-female snap of said cover said braid band is perfectly aligned.

7 Claims, 7 Drawing Figures

Fig. 1
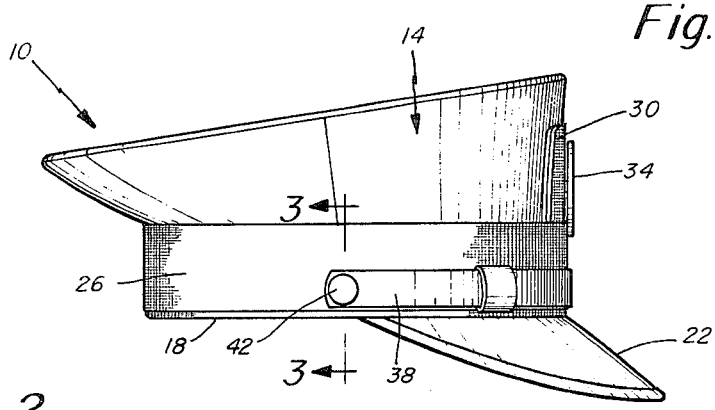
Fig. 2
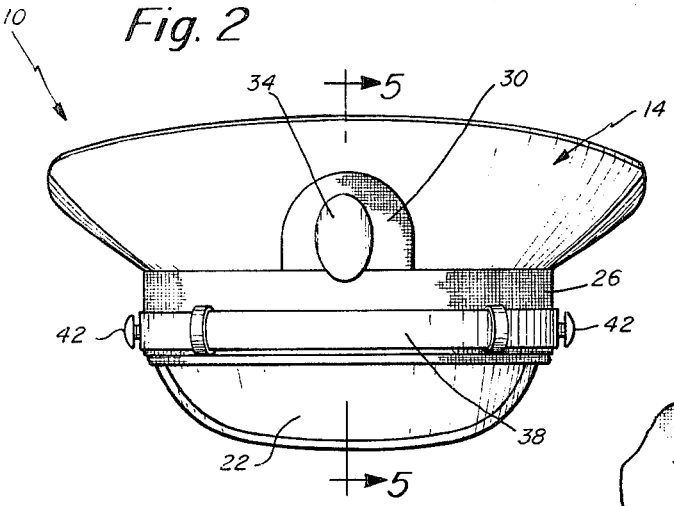
Fig. 3
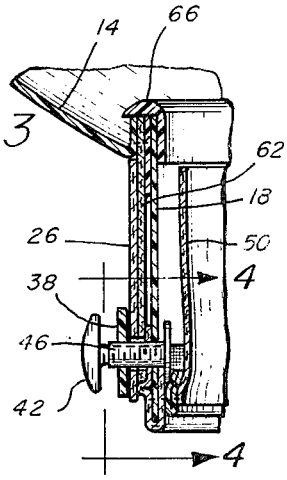
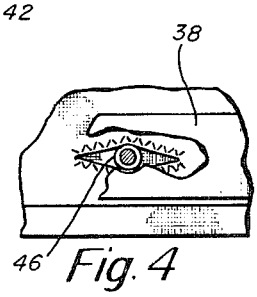
Fig. 4
Fig. 5
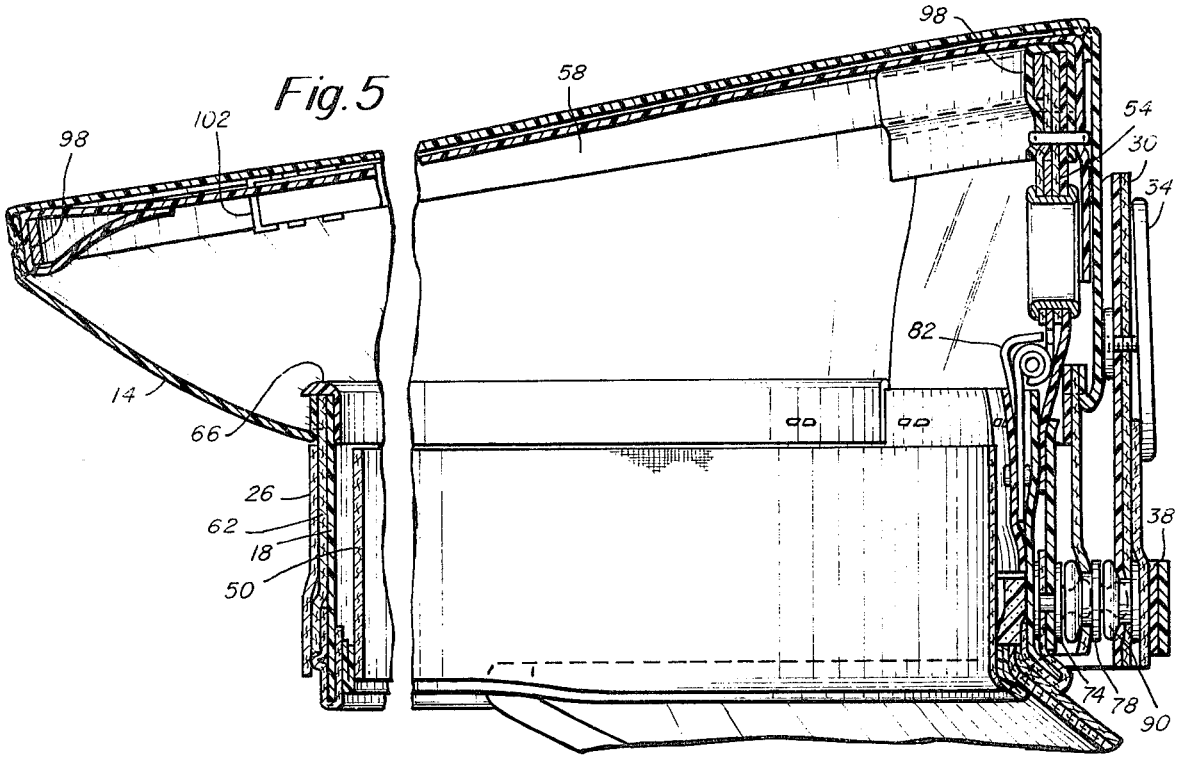

UNIFORM CAP

SUMMARY AND BACKGROUND OF THE INVENTION

Uniform caps of the type worn by military officers and others are commonly made with a relatively stiff frame, a visor and cover having a flaring front peak and an aligned braid band with appropriate decorations or insignia. Because of requirements of dress or because of weather conditions, users find it convenient to have caps in which one cover may be replaced easily by another. Caps having such interchangeability are known in the art; however, they have had associated with them various disadvantages. Because the covers which may be used with such caps have differing constructions and sizes there has been a requirement for an adjustable stretching band to properly smoothly deploy the cover. In prior art hats the means for adjusting and locking into adjustment the stretching band has not been completely satisfactory.

Another problem associated with this type of cap has been the difficulty of properly aligning and maintaining in alignment the decorated braid band. A desirable improvement which the present invention provides is a simple means to effect such alignment and to secure the braid band against shifting.

Because of the large number of sizes in which uniform caps come and because of the number of different covers required in their use, dealers have been forced to carry large inventories of covers to match the size and dress requirements of each user. A desirable improvement which the present invention provides is a cover which can be used for a relatively large range of sizes of caps. Dealers and suppliers who provide such caps will be able to eliminate a large percentage of their inventory requirements while still being able to provide for the needs of their customers.

One object of the present invention is to provide a uniform cap having a cover which can be used with frames of a wide range of sizes. Another object of the present invention is to provide a uniform cap with a replaceable cover for which dealer's inventory requirements are diminished.

A further object of the present invention is to provide a uniform cap having an adjustable stretching band for smooth and even deployment of its cover on the frame with a simply operable locking means. Still a further object of the present invention is to provide a uniform cap in which the locking means which secures the size of the stretching band will not accidentally release and which enables use of the band with different size covers.

Another object of the invention is to provide a stretchable braid band for carrying insignia on a uniform cap.

A further object of the present invention is to provide a uniform cap having means for the simple and secure alignment of the braid band on said cap. Still a further object of this invention is to provide a uniform cap in the use of which a user can easily align the emblem located on the braid band at the front-center of the cap.

According to the invention, a uniform cap comprises a frame constructed and arranged to fit the head of a user. A stay located at the front of the frame maintains the front of the cover in its flaring condition. Preferably interconnected with the frame at the top of the stay is the adjustable stretching band which engages with the cover along its top edge in order to stretch the cover into its smooth deployed position. It is a feature of the present invention that the means for locking the stretching band at an appropriate size comprises the fanged loop piece located at one end of the stretching band and through which the other end threads. A slidable releasing means biases a portion of the stretch band threading through the loop piece into a configuration approximately parallel with the plane of the loop so that the fangs engage with and lock said portion.

Another feature of the present invention is a male snap located at the front center of the frame, a male-female snap located at the front center of the cover and which engages with the male snap in the frame, and a female snap located at the front center of the braid band which engages with the male portion of the snap located on the cover. When these three snaps are engaged, the braid band is properly aligned with its emblem appropriately centered. With these snaps being secured to one another in this fashion, no accidental disalignment of the braid band with respect to the frame can occur.

A further feature of the present invention is that the cover has a lower portion made of elasticized material. A cover made in this fashion can be used with frames of a wide range of head sizes. A dealer need only carry a small number of sizes of these covers for all sizes of the frames. Preferably the braid band is elastically stretchable and adjustable to different size frames. Close woven Lycra braids are preferred for use in this invention. Other elastic weaves and materials can be used. Since the braid band is adjustable to different size frames as is the cap cover and the stretching band is adjustable to different size cap covers, inventories of all three are substantially reduced.

These and other objects, features and advantages of the present invention will be better understood from a reading of the following specification in conjunction with drawings in which:

BRIEF FIGURE DESCRIPTION

FIG. 1 is a side view of a uniform cap which is one embodiment of the present invention;

FIG. 2 is a front view of the uniform cap shown in FIG. 1;

FIG. 3 is a fragmentary cross-sectional view of the cap of FIG. 1 taken through the line 3—3 of FIG. 1;

FIG. 4 is a cut-away view of a fragment of the side of the cap taken in the region through which the line 3—3 of FIG. 1 passes;

FIG. 5 is a cross-sectional view of the cap shown in FIG. 2 taken through the line 5—5;

DETAILED FIGURE DESCRIPTION

Figure 6:
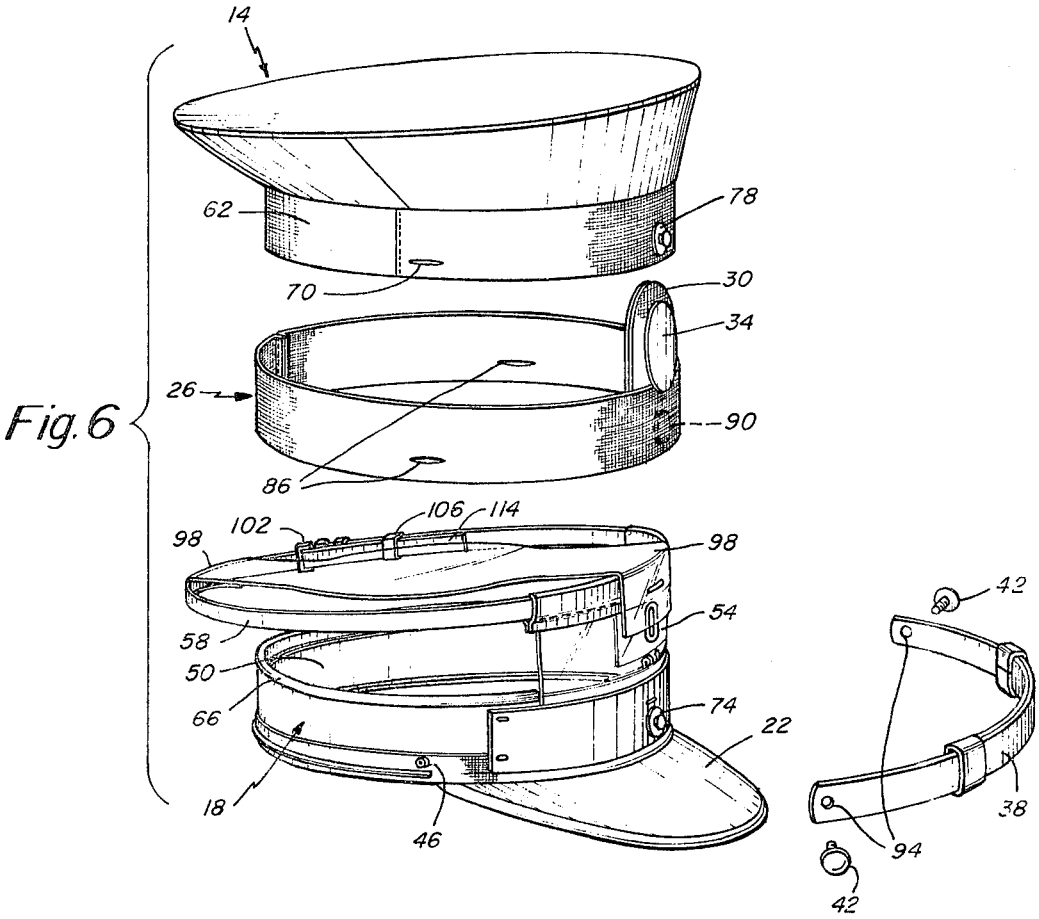
FIG. 6 is an exploded view of the cap of FIG. 1.

One embodiment of the present invention is the uniform cap shown generally at 10 in FIG. 1. This cap has a cover 14, frame 18 with a visor 22 attached to the front thereof, a braid band 26 having an emblem flap 30 on which is located an emblem 34, and a decorative strap 38. Two button screws 42 secure the decorative strap 38 at either side of the frame by being threaded into threaded locators 46. The locators are secured in the frame as shown in FIGS. 3 and 4.

The frame 18, which may be made out of suitably stiff material such as plastic, has a sweat band 50 located on its inside for the comfort of the wearer and has a stay 54 located at its front. The stay serves two functions: first it maintains the forward flaring peak of the cover in position, and second it provides the interconnection between the frame and the stretching band 58. The stretching band, as will be discussed in more detail below, maintains the cover 14 in smooth deployment when the latter is located upon the frame 18.

The cover 14 fits over the frame in such a way that the lower portion of the cover 62 snugly hugs the frame and engages the frame lip 66. The lower portion 62 is made out of an elasticized material. This feature makes it possible for a single cover to be used with frames of various sizes. The lower portion of the cover 62 has holes 70 through which the threaded locators 46 penetrate to secure the decorative strap 38. At its front-center (intermediate its sides), just above the visor 22, the frame 18 has a male snap 74 facing outwardly. A corresponding male-female snap 78, located at the front-center (intermediate the sides) of the lower portion 62 of the cover 14, engages the male snap 74 to align the cover on the frame 18. It should be noted that as depicted the stay 54 may be attached to the rest of the frame by a hinge construction 82 of a type which is known in the art. With such a hinge construction, the hat can be collapsed and stored in a flat container.

The braid band 26 which is made out of stretchable material fits over the frame 18 and the lower portion 62 of the cover 14 located thereon. Preferably the braid band 26 is formed of a woven elastic braid of the type known for use in waistbands of undergarments. There are located in the braid band holes 86 through which the threaded locators 46 penetrate in order to secure the decorative strap 38. At the front-center (intermediate the sides) of the braid band, at its bottom and behind the emblem flap 30, is located a female snap 90. The snap 90 engages with the male portion of the male-female snap 78 which is located on the lower portion of the cover 62. This engagement secures the braid band in proper alignment. The set of snaps 74, 78 and 90 provide a user with a convenient and simple way of aligning the braid band 26 of his cap so that the emblem and emblem flaps are appropriately centered. This assembly further guarantees that no accidental disalignment can occur after the braid band is put in place.

The decorative strap 38 is located over the braid band at the front of the cap as shown in FIG. 1. It is secured to the cap by the button screws 42 which go through holes 94 in the strap and thread into the threaded locators 46.

Figure 7:
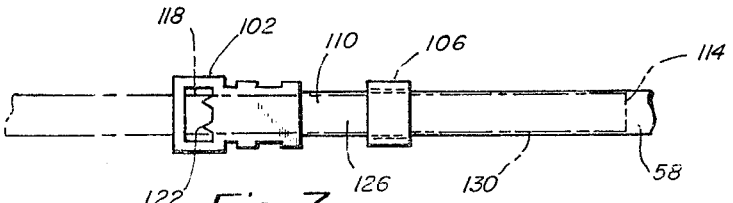
FIG. 7 shows the detail of the locking means of the stretching band of the embodiment of the uniform cap shown in FIG. 1.

Because it is desirable to be able to use different covers with the same frame, and such covers may have varying dimensions, it is important that the stretching band 58, which is attached to the stay 54 by stretching band holder means 98, be adjustable. To that end, the stretching band has lockable adjusting means comprising a fanged loop piece 102 and a slidable releasing means 106. The loop piece 102, which is planar as shown in FIG. 7, is secured to a first end 110 of the stretching band 58. The second end 114 of the stretching band 58 penetrates through the loop piece 102. When the portion 118 of the stretching band which threads through the loop piece is essentially coplanar with the loop piece, the fangs 122 engage and thereby lock the portion 118 in position. Adjustment of the stretching band 58, so that it may be adapted to different covers 14, is effected by causing the portion 118 threading through the loop piece 102 to be brought into a substantially perpendicular relationship with the loop piece. In that configuration the fangs 122 disengage from the portion 118 and the stretching band may be easily slid through the loop piece 102. Slidable releasing means 106 surrounds and holds in contiguity a first segment 126 of the stretching band near its first end 110, and a second segment 130 of the stretching band near its second end 114. By moving the slidable releasing means 106 into proximity with the loop piece 102 the user biases the portion 118 into a configuration coplanar with the loop piece thereby effecting the locking engagement of the fangs described above. The stretching band 58 remains locked at the size desired by the user until the slidable releasing means 106 is moved out of close proximity with the loop piece 102. When the means 106 is so removed the portion 118 threading through the loop piece may be brought into a nearly perpendicular relation with the plane of the loop piece and as described above the stretching band may be adjusted.

What is claimed is:

1. In a uniform cap having a frame arranged to fit the head of a user, a flexible replaceable cover interconnected with and over said frame, and a stretching band above said frame so as to stretch said cover into its deployed condition, the improvement in which said stretching band is adjustable and has lockable adjusting means comprising a planar loop piece having fangs that project into the loop and being attached to and substantially coplanar with the first end of said stretching band with a portion of said stretching band proximate the second end of said stretching band threading through said loop piece, said fangs engaging and locking said portion to said first end when the plane of said loop piece is substantially parallel to said portion, said fangs being disengaged from and allowing free movement of said stretching band through said loop piece when the plane of said loop piece is substantially perpendicular to said portion threading through said loop piece, slidable releasing means for holding a first segment of said stretching band near said first end in close and parallel continguity with a second segment near said second end, said releasing means, when slid into contiguity with said loop piece, maintaining said portion substantially parallel to the plane of said loop piece, said releasing means, when slid away from said loop piece, allowing said portion to be brought into perpendicular relation to said plane of said loop piece.

2. In a uniform cap having a frame to fit the head of a user, a flexible replaceable cover, releasable means for aligning and fastening said cover to said frame, means to stretch said cover into its deployed condition, and a braid band the improvement in which said means for aligning said cover comprises a first means located on said frame intermediate its sides, a second means at a corresponding location on said cover releasably engaging with said first means, said braid band carrying an emblem flap and being elastically stretchable and removably located over said frame and the lower portion of said cover, and having a third means intermediate its sides connected to the emblem flap, releasably engaging said first means to positively align said emblem flap, said first means being an outwardly facing male snap located intermediate the sides of the frame at its front-center, said second means being a male-female snap located intermediate the sides of the cover at its front-center, said third means being an inwardly facing female snap located intermediate the sides of the braid band at its front center, the female portion of said male-female snap facing inwardly to engage said male snap, the male portion of said male-female snap facing outward to engage said female snap so as to releasably fasten and align said braid band on said frame.

3. A uniform cap having the improvement described in claim 2 further characterized by the lower portion of said cover, which engages with and is secured to said frame by said releasable means, being formed of an elastic material so that said cover may be used with frames of varying sizes.

4. A uniform cap as described in claim 3 further characterized by said means to stretch said cover comprising a stretching band interconnected with said frame, said stretching band being adjustable and having lockable adjusting means comprising a fanged planar loop piece attached to and substantially coplanar with the first end of said stretching band with a portion of said stretching band proximate the second end of said stretching band threading through said loop piece, said fangs engaging and locking said portion to said first end when the plane of said loop piece is substantially parallel to said portion, said fangs being disengaged from and allowing free movement of said stretching band through said loop piece when the plane of said loop piece is substantially perpendicular to said portion threading through said loop piece, slidable releasing means for holding a first segment of said stretching band near said first end in close and parallel contiguity with a second segment near said second end, said releasing means, when slid into contiguity with said loop piece, maintaining said portion substantially parallel to the plane of said loop piece, said releasing means when slid away from said loop piece allowing said portion to be brought into perpendicular relation to said plane of said loop piece.

5. A uniform cap as described in claim 4 further characterized by an emblem being located at the center-front intermediate the sides, of the braid band and facing outwardly so as to be observable.

6. In a uniform cap having a frame arranged to fit the head of a user, a flexible replaceable cover, releasable means for aligning and fastening said cover to said frame, means to stretch said cover into its deployed condition, and a braid band, the improvement in which the lower portion of said cover, which engages with and is secured to said frame by said releasable means, is formed of an elastic material so that said cover may be used with frames of varying sizes, said means to stretch said cover comprising a stretching band interconnected with said frame, said stretching band being adjustable and having lockable adjusting means comprising a planar loop piece having fangs that project into the loop and being attached to and substantially coplanar with the first end of said stretching band with a portion of said stretching band proximate the second end of said stretching band threading through said loop piece, said fangs engaging and locking said portion to said first end when the plane of said loop piece is substantially parallel to said portion, said fangs being disengaged from and allowing free movement of said stretching band through said loop piece when the plane of said loop piece is substantially perpendicular to said portion threading through said loop piece, slidable releasing means for holding a first segment of said stretching band near said first end in close and parallel contiguity with a second segment near said second end, said releasing means, when slid into contiguity with said loop piece, maintaining said portion substantially parallel to the plane of said loop piece, said releasing means when slid away from said loop piece allowing said portion to be brought into perpendicular relation to said plane of said loop piece.

7. In a uniform cap having a frame arranged to fit the head of a user, a flexible replaceable cover, releasable means for aligning and fastening said cover to said frame, means to stretch said cover into its deployed condition, side locators mounted on said frame securing a decorative front strap, and a braid band, the improvement comprising, said braid band being formed of a stretchable material and carrying an emblem flap, said emblem flap being located intermediate sides of said cap and at the front center of the cap, said emblem flap carrying locating means for releasable attachment thereof to said frame at said front center so as to positively fix said braid band at a front center position yet allow stretching thereon at points about said frame, said locating means being carried by said emblem flap and constructed and arranged to cooperate with a mating locating means on said frame, and said braid band defining side holes for permitting passage therethrough of said locators for said decorative front strap of said cap.

* * * * *